US007290651B2

(12) United States Patent
Irwin et al.

(10) Patent No.: US 7,290,651 B2
(45) Date of Patent: Nov. 6, 2007

(54) CADDY FOR CLEANING SUPPLIES

(75) Inventors: John T. Irwin, Toledo, OH (US); Stephen A. Dukes, North Baltimore, OH (US); Donald T. Soncrant, Toledo, OH (US)

(73) Assignee: Impact Products, LLC, Toledo, OH (US)

( * ) Notice: Subject to any disclaimer, the term of this patent is extended or adjusted under 35 U.S.C. 154(b) by 301 days.

(21) Appl. No.: 10/912,916

(22) Filed: Aug. 6, 2004

(65) Prior Publication Data

US 2006/0027469 A1 Feb. 9, 2006

(51) Int. Cl.
*B65D 1/24* (2006.01)

(52) U.S. Cl. ..... 206/216; 206/373; 220/500; 220/694

(58) Field of Classification Search ..... 206/515, 206/249, 565, 518, 372, 49, 216, 506, 373; 248/295.11, 323, 290.1, 297.31; 220/751, 220/500, 694
See application file for complete search history.

(56) References Cited

U.S. PATENT DOCUMENTS

| | | | | |
|---|---|---|---|---|
| 630,322 | A | 8/1899 | Brown | |
| 900,014 | A | 9/1908 | Purdy | |
| 2,042,801 | A | 6/1936 | Pittman | |
| D139,569 | S | 11/1944 | O'Brien | |
| 2,530,819 | A | 11/1950 | Hamlin | |
| 2,864,510 | A | 12/1958 | Sture | |
| 3,107,027 | A | 10/1963 | Hong | |
| 3,219,226 | A | 11/1965 | Schroeder | |
| 3,298,532 | A | 1/1967 | Wilcke | |
| 3,407,429 | A * | 10/1968 | Di Nardo | 15/257.01 |
| 3,731,333 | A | 5/1973 | Davis | |
| 4,428,493 | A | 1/1984 | McDonough | |
| 4,561,556 | A | 12/1985 | Bendix | |
| 4,720,021 | A * | 1/1988 | Byrns | 220/764 |
| 5,086,917 | A | 2/1992 | Dziersk et al. | |
| 5,092,463 | A | 3/1992 | Dees | |
| 5,154,303 | A | 10/1992 | Jordan | |
| 5,174,447 | A | 12/1992 | Fleming | |
| 5,199,571 | A | 4/1993 | Wolff et al. | |
| 5,303,500 | A | 4/1994 | Luukonen | |
| D350,632 | S | 9/1994 | Cummins | |
| 5,350,065 | A | 9/1994 | Darrey | |
| D353,241 | S | 12/1994 | Breen | |
| 5,370,263 | A * | 12/1994 | Brown | 220/751 |
| 5,390,944 | A | 2/1995 | Sherwin | |
| 5,400,916 | A | 3/1995 | Weber | |
| 5,419,451 | A | 5/1995 | Bitel, Jr. | |
| 5,547,098 | A | 8/1996 | Jordan | |
| D376,454 | S | 12/1996 | Fierek et al. | |
| 5,634,568 | A | 6/1997 | Wawrzyniak | |
| 5,669,498 | A | 9/1997 | Fierek et al. | |
| 5,704,496 | A | 1/1998 | Latta | |
| 5,772,066 | A | 6/1998 | Reynolds | |
| 5,803,305 | A | 9/1998 | Perlis et al. | |
| 5,833,095 | A | 11/1998 | Russell et al. | |
| 5,881,891 | A | 3/1999 | Murphy, Jr. | |

(Continued)

*Primary Examiner*—Mickey Yu
*Assistant Examiner*—Steven A. Reynolds
(74) *Attorney, Agent, or Firm*—Fraser Clemens Martin & Miller LLC

(57) ABSTRACT

A caddy for cleaning supplies including a pair of spaced apart compartments and attachments for attendant implements wherein the caddy may be detachable supported on the rim of an associated collection bin.

18 Claims, 9 Drawing Sheets

U.S. PATENT DOCUMENTS

| | | | | |
|---|---|---|---|---|
| D411,674 | S | 6/1999 | Haley et al. | |
| D425,277 | S | 5/2000 | Kent | |
| 6,059,109 | A * | 5/2000 | Stein | 206/373 |
| 6,062,389 | A * | 5/2000 | Kent | 206/518 |
| 6,098,805 | A * | 8/2000 | Kent | 206/518 |
| 6,138,827 | A | 10/2000 | Marshall | |
| 6,138,963 | A | 10/2000 | Malvasio | |
| 6,308,379 | B1 | 10/2001 | Hendrickson et al. | |
| 6,357,616 | B1 | 3/2002 | Harris et al. | |
| 6,460,697 | B1 | 10/2002 | Stevens | |
| 6,575,416 | B1 * | 6/2003 | Avinger | 248/307 |
| D477,447 | S | 7/2003 | Calaicone | |
| 6,607,088 | B2 | 8/2003 | Cestrone | |
| D482,830 | S | 11/2003 | Kohn | |
| D484,700 | S | 1/2004 | Weiser et al. | |
| 6,823,998 | B2 * | 11/2004 | Fabregas | 211/70.6 |
| D516,227 | S * | 2/2006 | Price | D25/68 |
| 2003/0213090 | A1 | 11/2003 | Holsten et al. | |

* cited by examiner

CADDY FOR CLEANING SUPPLIES

BACKGROUND OF THE INVENTION

1. Field of the Invention

The present invention relates to article storage devices and more particularly to a caddy for storing and transporting cleaning supplies and the like.

2. Description of the Prior Art

Caddy devices for storing and transporting are well known in the art. Such devices are typically capable of being carried on the rim of the commercial and household waste collection bins. The devices are used to contain many various supplies and implements used in cleaning commercial establishments, offices, schools, homes and other similar locations. The waste collection bins are generally defined by an upstanding wall defining a circular opening or an upstanding wall forming a generally rectangular opening. The varying shape of the openings of the collection bins have required, in many instances, separately designed and shaped caddies for each differently shaped waste collection bin.

It would be advantageous to develop a single caddy which could be used to readily attach to the upper rims of waste collection bins of a circular configuration, as well as, those defining a rectangular opening.

SUMMARY OF THE INVENTION

It is an object of the present invention to produce a caddy for storing and transporting cleaning supplies and the like which may be readily attached to a waste collection bin.

Another object of the invention is to produce a caddy for cleaning supplies which may be attached to the rim of a waste collection bin.

Another object of the invention is to produce a caddy for cleaning supplies which may be readily attached to the rim of a waste collection bin whether the rim be curved or rectangular in shape.

Still another object of the invention is to produce a caddy for cleaning supplies which may be detactably affixed to the rim of a waste collection bin and is capable of maintaining selected cleaning items therein in an orderly fashion.

Still a further object of the invention is to produce a caddy for cleaning supplies which may be readily detached from an associated waste collection bin and transported to a separate location.

The above, as well as other objects of the invention have been surprisingly achieved by a caddy for cleaning supplies comprising a first compartment; a second compartment; means for maintaining the first and second compartment in spaced relation to produce a space therebetween for receiving the rim of an associated waste collection bin; and a handle attached to the means for maintaining the first and the second compartments in spaced for facilitating the manual transport of the caddy from sites to sites.

BRIEF DESCRIPTION OF THE DRAWINGS

Other objects and advantages of the invention will become manifest to those skilled in the art from reading the following detailed description of a preferred embodiment of the invention when considered in the light of the accompanying drawings, in which.

DETAILED DESCRIPTION OF THE PREFERRED EMBODIMENT

Figure 1:
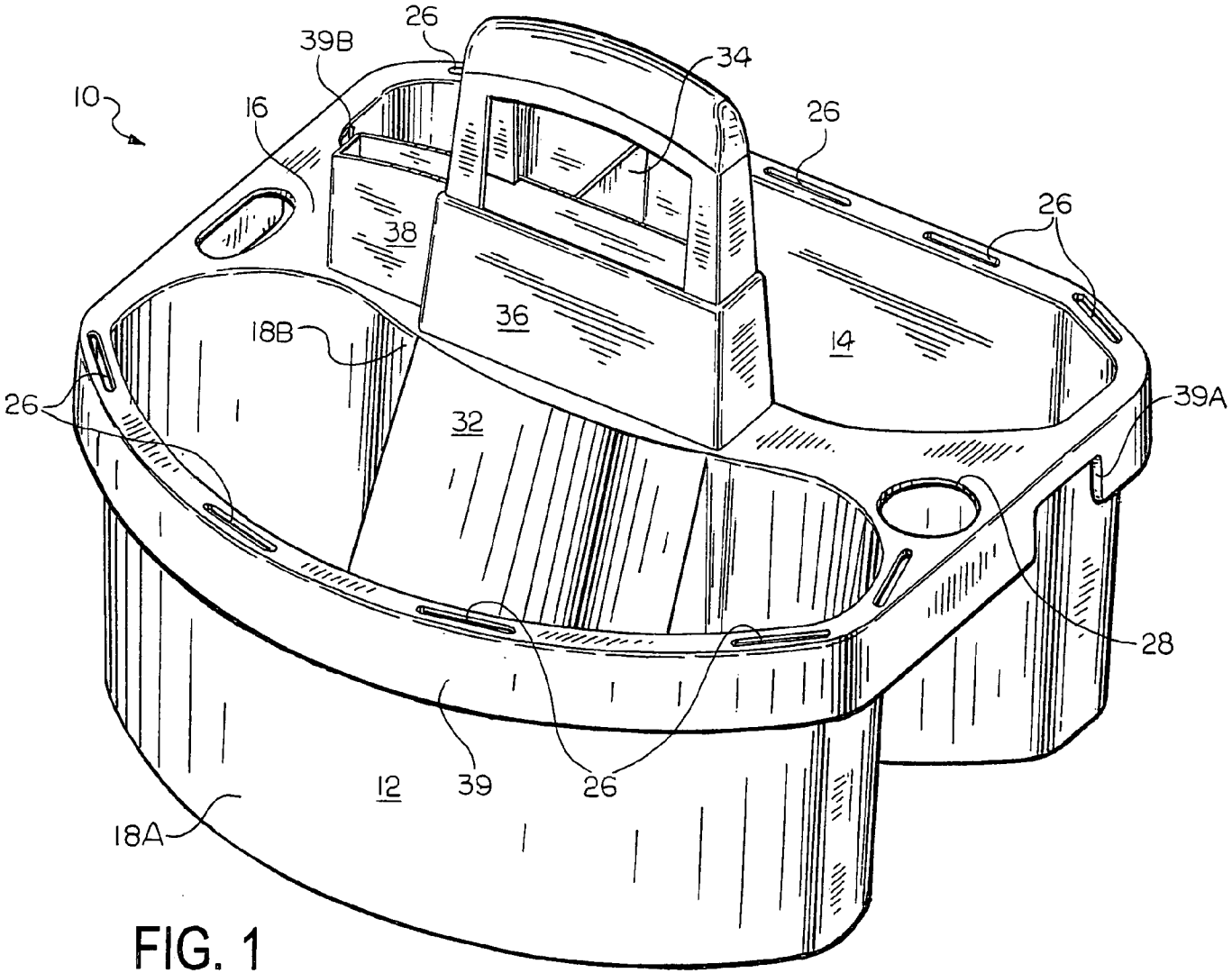
FIG. 1 is a front perspective of a caddy for cleaning supplies embodying the features of the invention.
Figure 2:
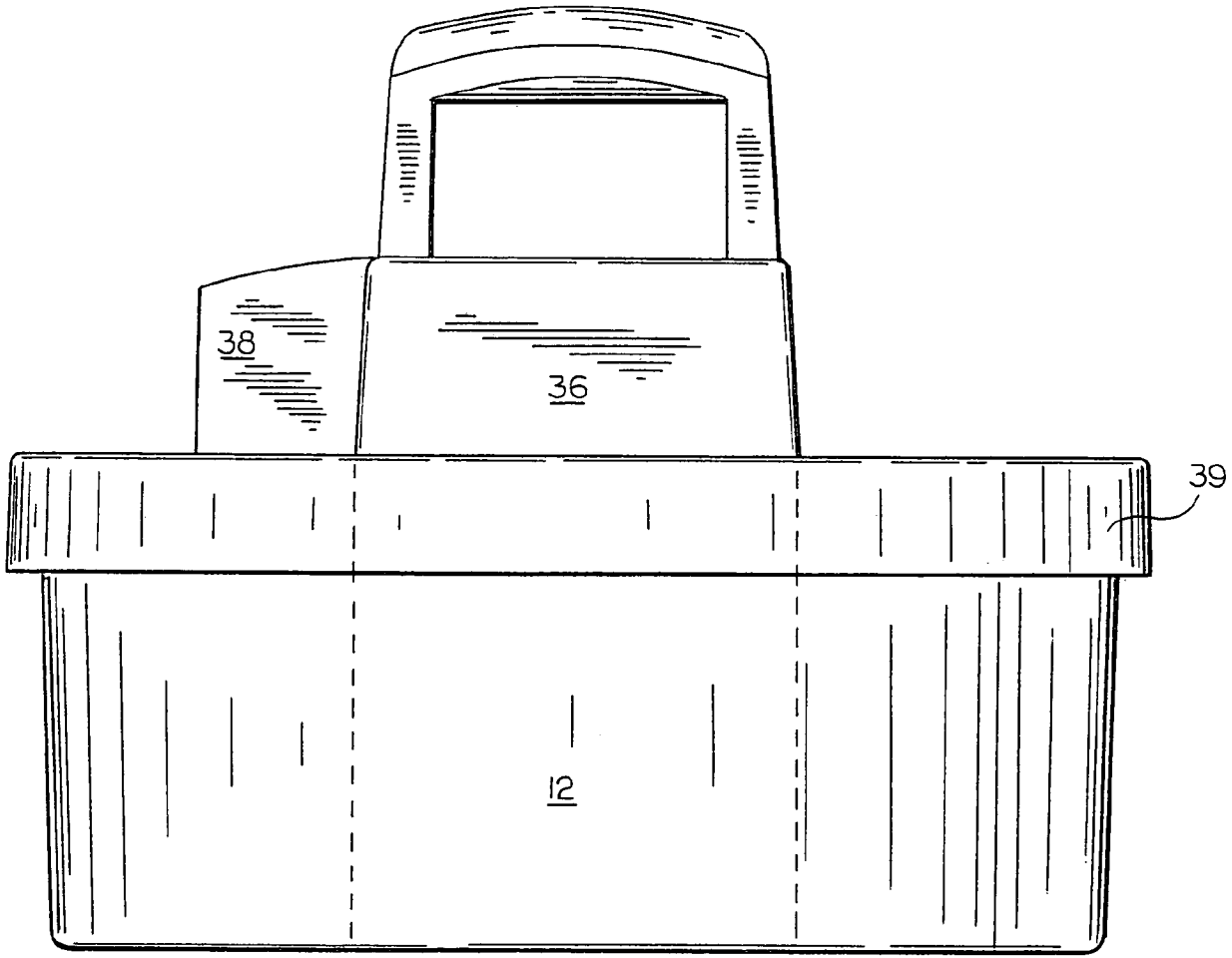
FIG. 2 is a front elevational view thereof.
Figure 3:
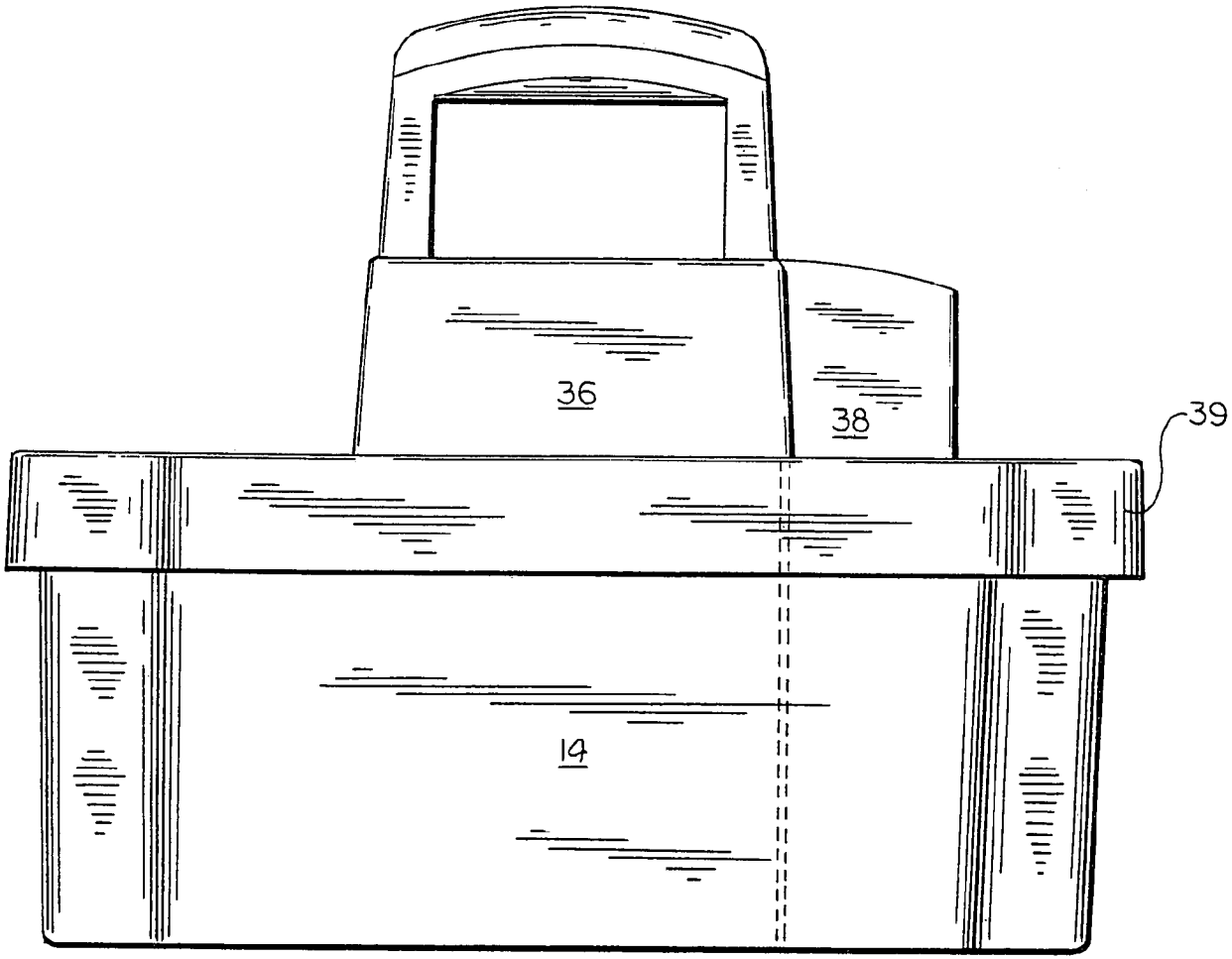
FIG. 3 is a rear view thereof.
Figure 4:
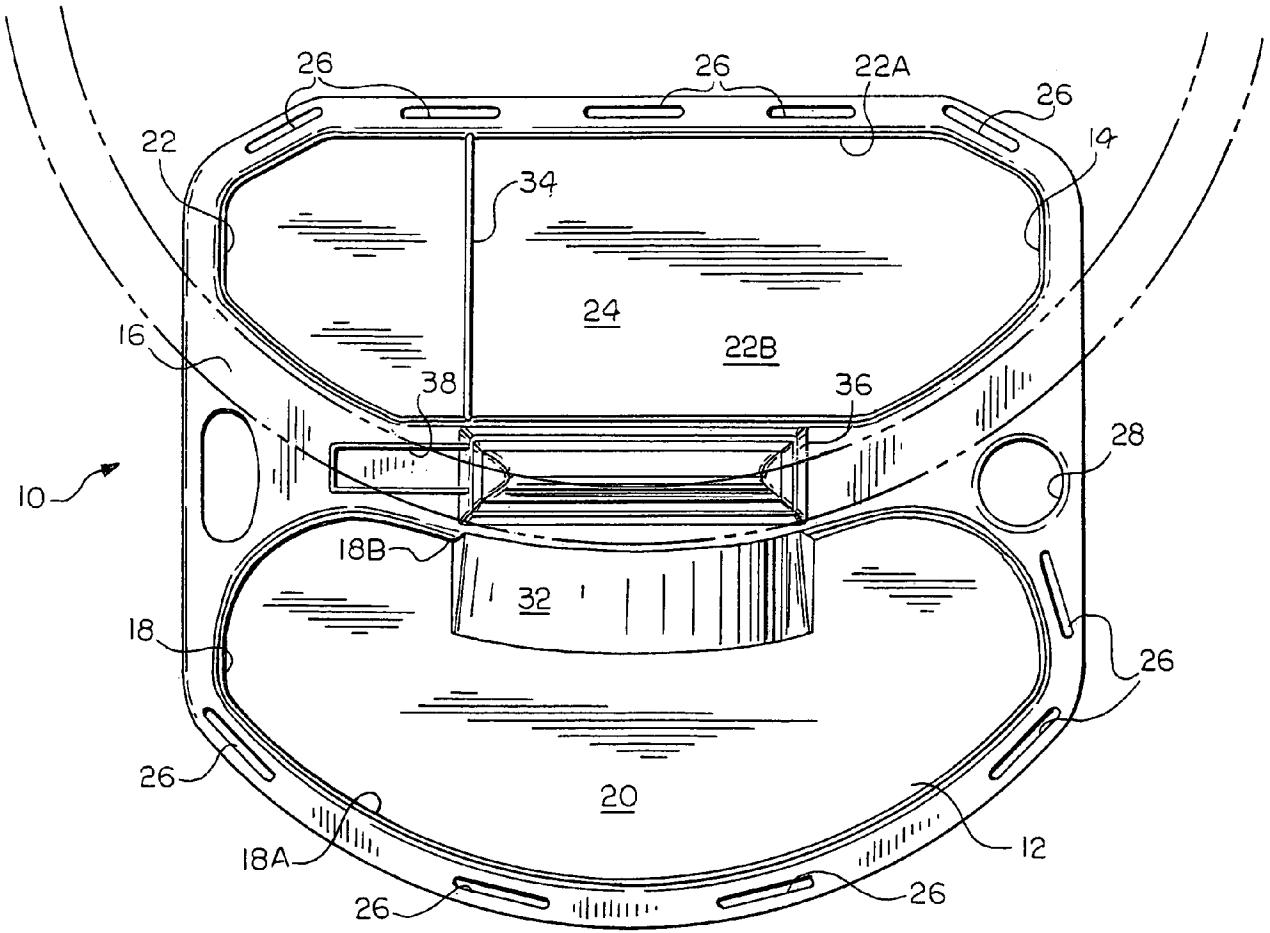
FIG. 4 is a top plan view thereof.
Figure 5:
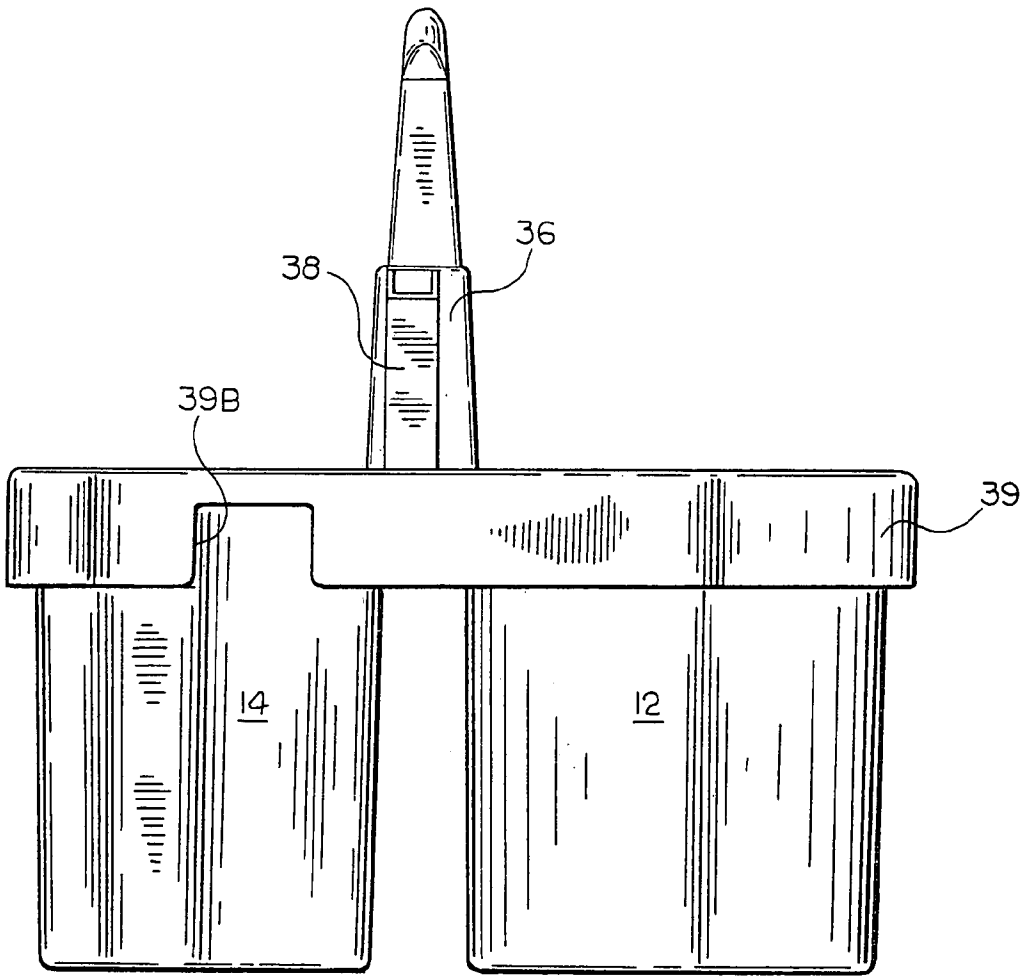
FIG. 5 is a left side view thereof.
Figure 6:
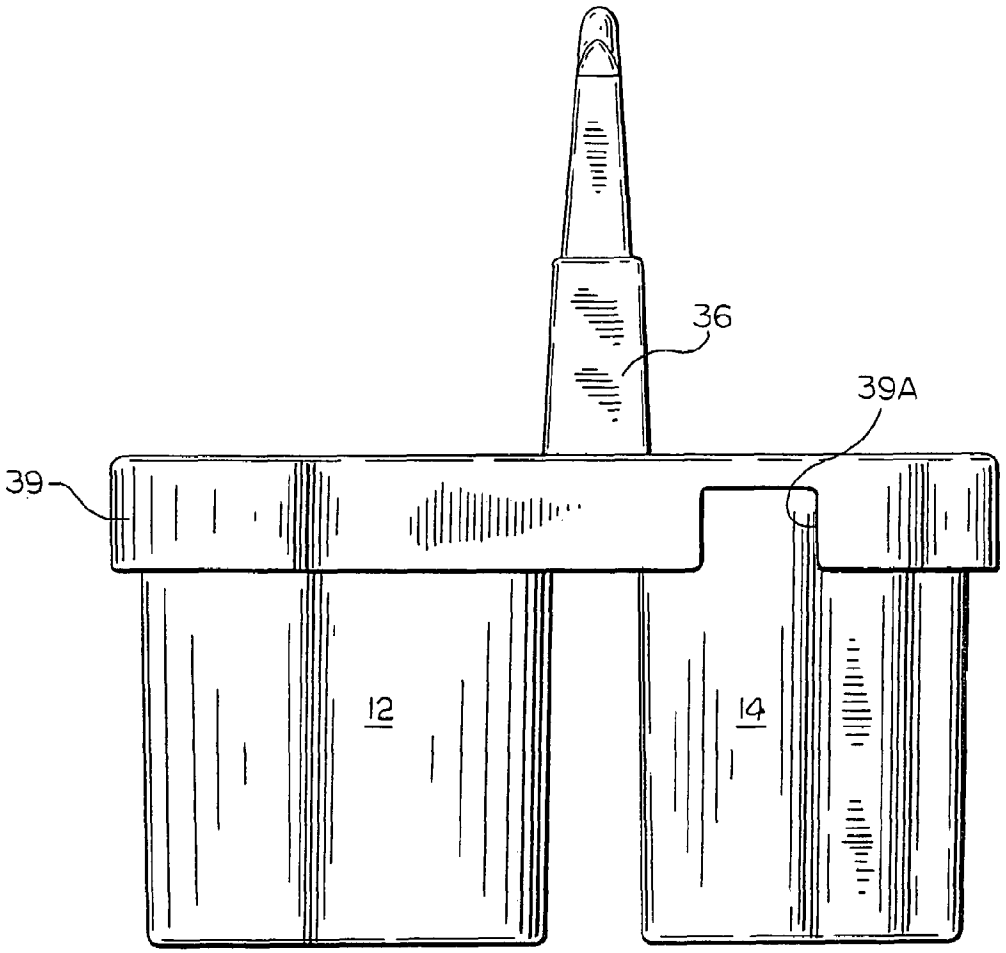
FIG. 6 is a right side view thereof.
Figure 7:
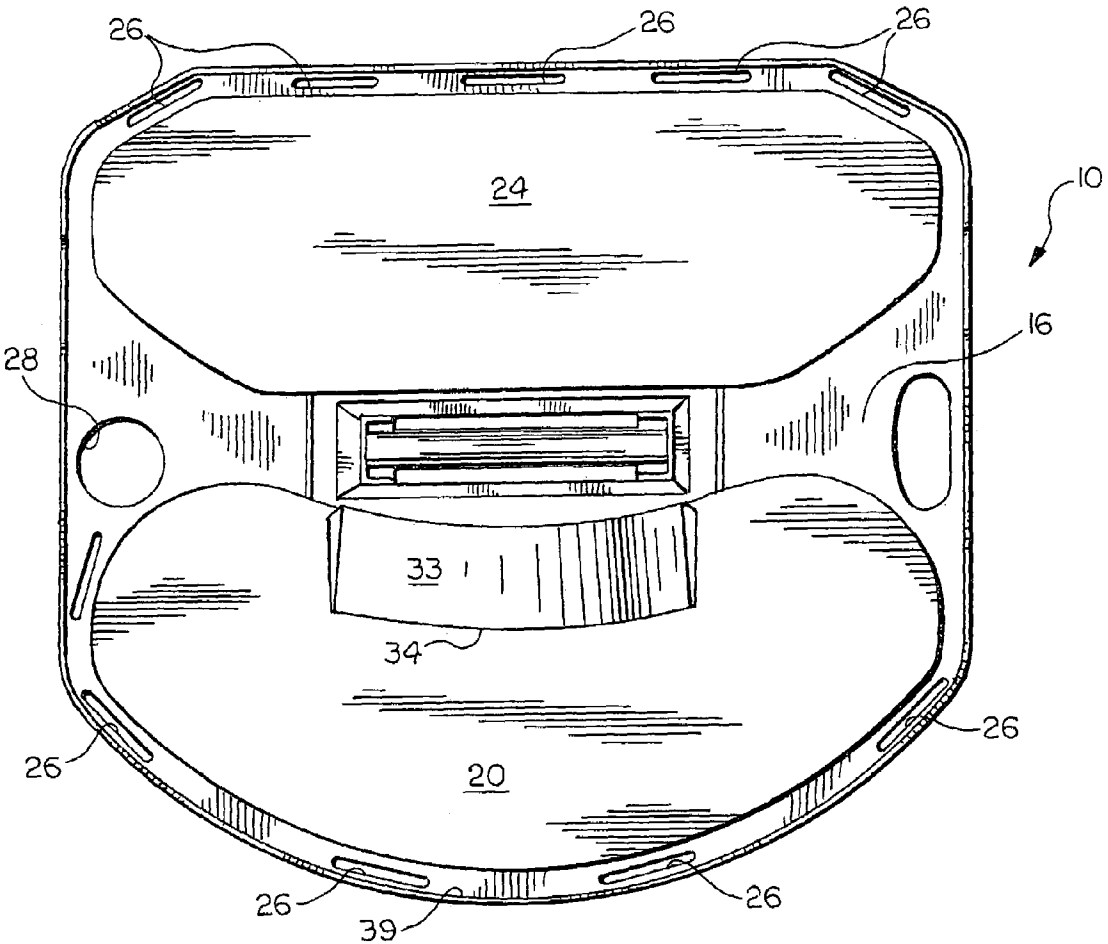
FIG. 7 is a bottom view thereof.

Referring to the drawings, there is illustrated, in FIGS. 1-7, a caddy for containing, transporting, and storing supplies used in the cleaning and maintenance of commercial establishments, for example. The caddy embodying the inventive features is generally indicated by reference numeral 10. The items typically carried by the caddy 10 include cleaning and sanitizing materials, soaps, waxes, brushes, cleaning cloths, sponges, and the like.

It will be appreciated that while the inventive concepts do not include the material from which the caddy 10 is fabricated, as a general rule it is contemplated that the structure will be formed of a plastic material, such as high density polyethylene. The plastic material is typically molded by an injection molding machine.

The caddy 10 includes two separate open top, closed bottom compartments 12, 14 which are separated by a web 16. The front compartment 12 is defined by an upstanding wall 18 which includes a curved outer portion 18A and a curved inner portion 18B. The compartment 12 further includes an opening top and a closed bottom wall 20. The rear compartment 14 is defined by an upstanding wall 22 which includes a continuous surrounding portion 22A including a generally flat planar portion 22B. The compartment 14 further includes an open top and a closed bottom wall 24.

The uppermost edges of the wall portions 18 and 22 of the front and rear compartment respectively terminate at and are joined to the web 16. The web 16 forms a lip portion which surrounds the open upper ends of the compartments 12 and 14 and provides structural integrity and strength to the overall caddy.

Figure 10:
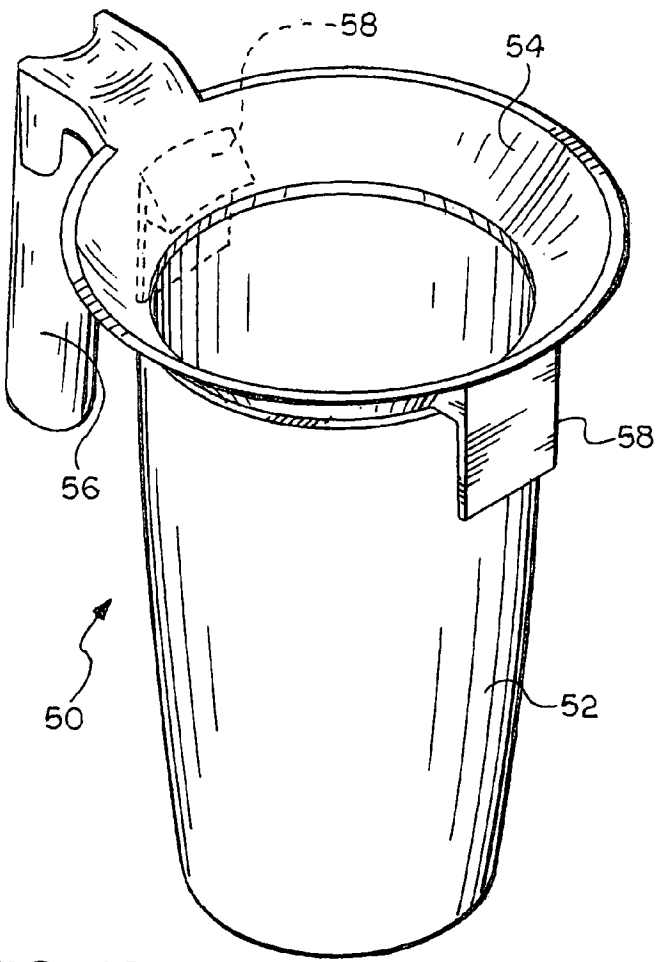
FIG. 10 illustrates a bowl mop caddy attachment.
Figure 8:
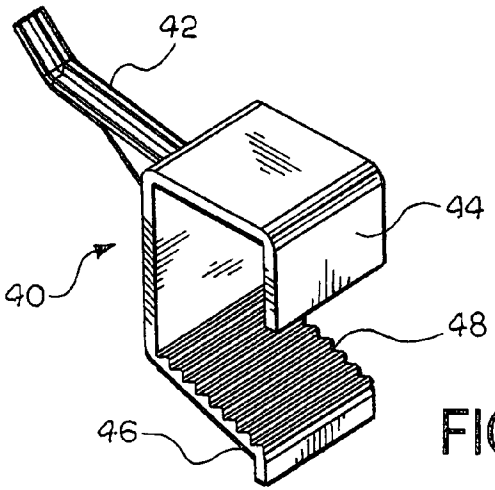
FIG. 8 illustrates a bracket attachment.
Figure 9:
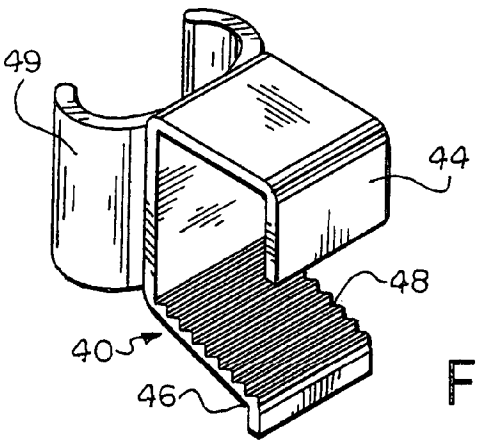
FIG. 9 illustrates an alternative bracket attachment.
Figure 11:
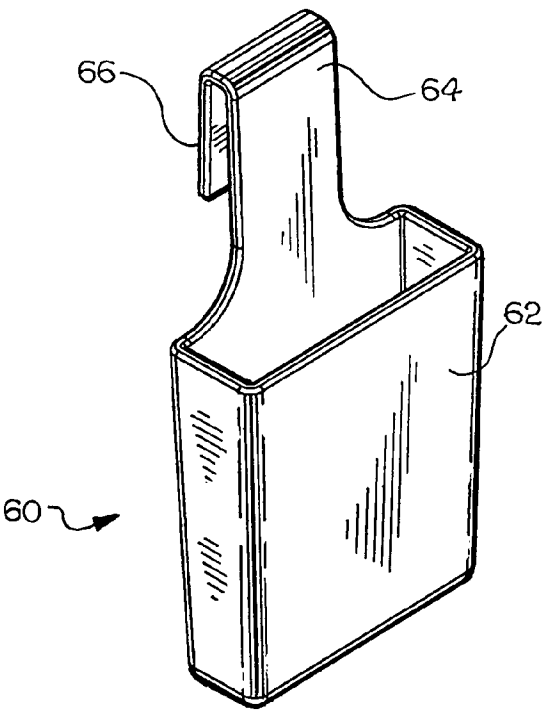
FIG. 11 illustrates a blade holder attachment.

The web 16 is provided with a series of spaced apart slots or openings 26 which may be used to hold brackets 40, 42 illustrated in FIGS. 8 and 9 respectively, for example. The slots 26 may also be employed to receive a bowl mop caddy 50 as illustrated in FIG. 10, for example. Also the slots 26 may be used to hold a blade holder 60 as illustrated in FIG. 11.

Figure 12:
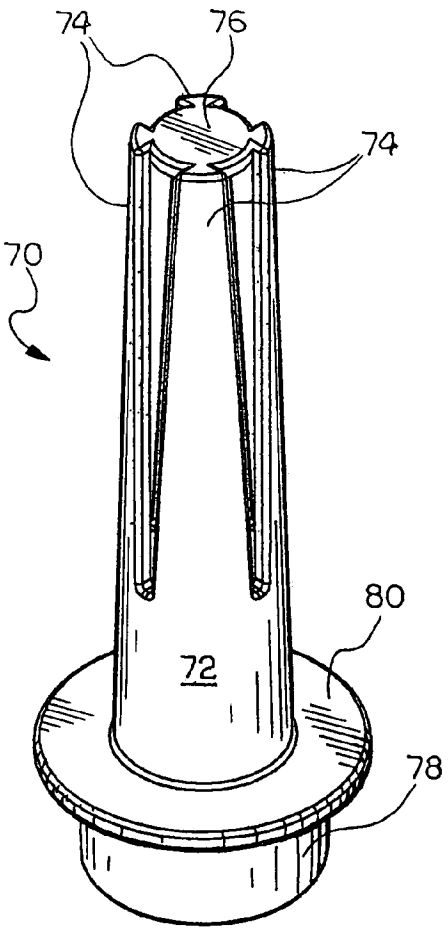
FIG. 12 illustrates a paper towel roll post attachment.

An annular or circular opening 28 is formed in the web 16 to receive an attachment 70 as illustrated in FIG. 12, for example.

The structures illustrated in FIGS. 8, 9, 10, 11, & 12 will be described in greater detail hereinafter.

An inclined wall 32 projects inwardly of the compartment 12 and creates a cavity 33 in the outwardly facing surface of the wall portion 18B. The cavity 33 is dimensioned to suitably receive one of the outwardly extending handles of an associated collection bin, for example. Thus, the caddy 10, when disposed in an operable position on the rim of the collection bin, is stable and will thereby militate against any relative rotational movement between the caddy 10 and an associated supporting collection bin.

A partition 34 may be positioned within the compartment 14 to divide the interior thereof into two separate compartments.

A handle 36 is formed to be integral with the web 16 by either being molded as an integral part thereof, or added, as by adhesive securement subsequent to the molding of the compartments 12 and 14 and the web 16.

A further compartment 38 is attached to the web 16 and the handle 36 to receive an implement such as a scraper, for example.

A skirt 39 is provided to depend downwardly from the web 16 and completely surround the outwardly facing surfaces of the walls 18 and 22. The skirt 39 is spaced outwardly from the outer walls 18 and 22 of the caddy 10. The skirt 39 provides additional structural rigidity and stability to the caddy 10 as well as provides a supplemental support surface for attaching bracketry, as will be explained in more detail hereinafter. The skirt 39 is provided with diametrically opposed notches 39A on the right side of the caddy 10, and 39B on the left side of the caddy 10. The notches 39A and 39B are designed to receive the upper rim portions of an associated collection bin.

The caddy 10 has been found suitable for use in transporting cleaning supplies with the typical waste collection bins. Such bins generally are provided with an open upper end defined by a generally circular rim. The caddy 10 is adapted to receive a sector of the circular rim within the space defined between the compartments 12 and 14. More specifically, the rim of the collection bin is received in the space between the facing surfaces of the curved inner portion 18B of the upstanding wall 18 of the compartment 12 and the flat planar portion 22A of the upstanding wall 22 of the compartment 14. It will be understood that when the caddy 10 is fully positioned on the rim of an associated waste collection bin, the lower surface of the web 16 of the caddy 10 in the region between the facing outer surfaces of the compartments 12 and 14 will rest upon and be supported by the upper rim of the collection bin. The radius of curvature of the wall portion 18B approximates the radius of curvature of the rim of the collection bin. Such curvature relationship permits a substantial amount of surface-to-surface contact between the outer surface of compartment 12 and the outer surface of the bin to impart stability to the caddy 10 during the disposition thereof on the collection bin.

While the above description explains the relationship between the caddy 10 and a collection bin having a curved supporting rim structure, there are instances in which it is desired to utilize the caddy 10 with a supporting rim which is not curved or formed on a radius. Surprisingly, it been found that the structure of the present caddy 10 is capable of receiving such supporting structures as well as those that are curved.

It will be noted that, in addition to the space between the facing wall portions of the walls 18 and 22, more specifically between the wall portion 18B and 22B being suitable for receiving a curved rim section of a supporting collection bin, the space is capable of receiving a rim section of a collection bin being a rectilinear rim. This capability results from and becomes manifest by observing the distance or zone between a chord joining the spaced apart points of the junctures of the curved wall portion 18B formed on a radius and the adjacent wall portions 18A of the compartment 12, and the planar wall section 22B of the wall 22 of the compartment 14. It will be observed from viewing the side views of FIGS. 5 and 6 wherein the space discussed above is unobstructed between the notches 39A and 39B formed in opposing portions of the skirt 39. The width of the notches 39A and 39B further defines the thickness limitation of the rim portion of an associated supporting bin.

Further structural aspects of the caddy 10 are disclosed in FIGS. 8-12 wherein various attachments are illustrated. FIG. 8 discloses an attachment bracket 40 having an integral hook 42. The main body of the bracket 40 includes downwardly extending tongue 44 which is adapted to be received against the uppermost inner edge surface of the walls 18 and 22 of the respective compartments 12 and 14, respectively. Opposite the tongue 44 is an angularly extending leg 46 having a series of rachet steps 48 adapted to selectively contact the lower edge of the depending skirt 39 as illustrated. The bracket 40 may easily lock in place on the depending skirt 39 by the rachet steps 48 springingly engaging the lower terminal edge of the skirt 39. Such action is possible due to the resilient connection between the tongue 44 and the rachet steps 48. Any number of different implements, such as scrapers, putty knives, and tools, cleaning cloths, rags, brushes, and the like may be hung on the hook 42. While the bracket 40 may be fabricated from a number of different materials, it has been found the resilience and memory of a plastic material such as, for example, high density polyethylene has been found to result in satisfactory operational relation between the tongue 44 and the rachet steps 48.

FIG. 9 shows the bracket 40 illustrated in FIG. 8 with a different supporting member 49 attached thereto. The supporting member 49 is useful for supporting a dust pan handle, for example.

FIG. 10 illustrates a bowl mop caddy 50 attachable to the caddy 10. More specifically, the bowl mop caddy 50 includes a container 52 having an open end defined by an enlarged angular outwardly and slightly upwardly extending lip 54. A handle 56 is formed to depend from the lip 54 in spaced relation to the outer surface of the container 52. A pair of radially displaced downwardly depending tongues 58 are formed to extend in spaced relation to the outer surface of the container 52. The tongues 58 are employed to detachably secure the mop bowl caddy 50 to the caddy 10. Attachment is achieved by directing one of the tongues 58 into any one of the slots 26 in the web 16 of the caddy 10.

FIG. 11 illustrates another attachment 60 which includes an open top container 62 and having an upwardly extending hook 64 with a downwardly extending tongue 66. As in the other attachments, the tongue 66 is adapted to be received with any one of the slots 26 formed in the web 16 of the caddy 10. The attachment may be used to contain an implement such as a scraper, for example.

FIG. 12 shows another attachment 70 which includes an upstanding columnar member 72 comprised of a series of annularly spaced apart spring fingers 74 joined at their respective terminal ends by a disc-like section 76. The end 78 opposite the section 76 is formed in the shape of a hollow cylinder having an outwardly extending shoulder 80. The attachment 70 may be detachably received and supported within the aperture or circular opening 28. In such a position the attachment 70 is suitable for receiving a paper towel roll, for example. The attachment 70 may also serve as a device to hold slender elongate objects, such as pencils, for example, by merely inverting the disposition thereof and inserting the columnar member 72 into the opening 28 until the shoulder 80 rests upon the web 16 defining the opening 28.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A caddy for cleaning supplies comprising:

a first compartment having at least one arcuately shaped wall portion;

a second compartment, wherein the arcuately shaped wall portion of said first compartment is in facing relation to said second compartment;

means for maintaining said first and second compartment in spaced relation to form a zone adapted to receive both an arcuately shaped rim and a rectangular shaped rim of an associated waste collection bin, wherein the zone is defined by the arcuately shaped wall portion of said first compartment and a wall portion of said second compartment; and a handle attached to said means for maintaining said first and second compartment in spaced relation.

2. A caddy as defined in claim 1, wherein said second compartment includes at least one straight planar wall portion.

3. A caddy as defined in claim 2, wherein the straight planar wall portion of said second compartment is in facing spaced relation to the arcuately shaped wall portion of said first compartment.

4. A caddy as defined in claim 1, wherein said means for maintaining said first and second compartments includes a web extending between said first and second compartments.

5. A caddy as defined in claim 4, wherein said first and second compartments each include an open upper end.

6. A caddy as defined in claim 5, wherein said web extends around the open upper end of said first and second compartments.

7. A caddy as defined in claim 6, including a skirt depending from said web.

8. A caddy as defined in claim 7, wherein said skirt is spaced outwardly from said first and second compartments.

9. A caddy as defined by claim 8, further comprising an implement containing attachment.

10. A caddy as defined in claim 9, wherein said web is provided with at least one opening for receiving said implement containing attachment.

11. A caddy as defined in claim 9, wherein said implement containing attachment includes a depending tongue portion received by the opening in said web.

12. A caddy as defined in claim 11, wherein said implement containing attachment includes a series of ratchet steps for selective contact with said skirt.

13. A caddy as defined in claim 11, wherein the series of ratchet steps and the tongue of said implement containing attachment are integrally attached.

14. A caddy as defined in claim 12, wherein the series of ratchet steps and the tongue of said implement containing attachment are resiliently attached to one another.

15. A caddy for cleaning supplies comprising:

a first compartment having at least one arcuately shaped wall portion, wherein the arcuately shaped wall portion is adapted to substantially abut an outer wall of a waste collection bin;

a second compartment, wherein the arcuately shaped wall portion of said first compartment is in facing relation to said second compartment;

means for maintaining said first and second compartment in spaced relation to form a zone adapted to receive both an arcuately shaped rim and a rectangular shaped rim of the associated waste collection bin, wherein the zone is defined by the arcuately shaped wall portion of said first compartment and a wall portion of said second compartment; and a handle attached to said means for maintaining said first and second compartment in spaced relation.

16. A caddy as defined in claim 15, wherein said second compartment includes at least one straight planar wall portion.

17. A caddy as defined in claim 16, wherein the straight planar wall portion of said second compartment is in facing spaced relation to the arcuately shaped wall portion of said first compartment.

18. A caddy for cleaning supplies comprising:

a first compartment having at least one arcuately shaped wall portion, wherein the arcuately shaped wall portion is adapted to substantially abut an outer wall of a waste collection bin;

a second compartment having at least one straight planar wall portion, wherein the straight planar wall portion of said second compartment is in facing spaced relation to the arcuately shaped wall portion of said first compartment;

means for maintaining said first and second compartment in spaced relation to form a zone adapted to receive both an arcuately shaped rim and a rectangular shaped rim of the associated waste collection bin, wherein the zone is defined by the arcuately shaped wall portion of said first compartment and the straight planar wall portion of said second compartment; and a handle attached to said means for maintaining said first and second compartment in spaced relation.

* * * * *